US012550992B2

(12) United States Patent
Charraud et al.

(10) Patent No.: US 12,550,992 B2
(45) Date of Patent: Feb. 17, 2026

(54) FORMULA DELIVERY APPLIANCE

(71) Applicant: L'Oreal, Paris (FR)

(72) Inventors: Gregoire Charraud, Jersey City, NJ (US); Juwan Hong, Jersey City, NJ (US); Rafael Feliciano, New Providence, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 18/757,879

(22) Filed: Jun. 28, 2024

(65) Prior Publication Data

US 2025/0000226 A1 Jan. 2, 2025

Related U.S. Application Data

(60) Provisional application No. 63/511,252, filed on Jun. 30, 2023.

(30) Foreign Application Priority Data

Sep. 12, 2023 (FR) ..... 2309584

(51) Int. Cl.
*A45D 19/02* (2006.01)

(52) U.S. Cl.
CPC ..... *A45D 19/026* (2021.01); *A45D 19/022* (2021.01)

(58) Field of Classification Search
CPC .. A45D 19/026; A45D 19/022; A45D 34/005; A45D 2200/054; A45D 2200/058; A45D 19/02; A45D 24/22; A45D 19/0066
See application file for complete search history.

(56) References Cited

U.S. PATENT DOCUMENTS 4,209,027 A * 6/1980 Morganroth ..... B65D 47/265 401/268
10,694,832 B2 6/2020 Grez
(Continued)

FOREIGN PATENT DOCUMENTS

JP 6775873 B2 10/2020
WO 2022/182669 A1 9/2022

OTHER PUBLICATIONS

France Search Report and Written Opinion mailed Mar. 5, 2024, issued in Application No. FR2309584, filed Sep. 12, 2023, 7 pages.
(Continued)

*Primary Examiner* — Vishal Pancholi
(74) *Attorney, Agent, or Firm* — Christensen O'Connor Johnson Kindness PLLC

(57) ABSTRACT

A formulation delivery appliance can be used for treatment of the hair and scalp, such as an appliance used to color hair. The appliance may include a container having an aperture and being configured to retain a volume of formulation. The formulation delivery appliance may further include an elongate engagement element having a channel extending therethrough and being configured to be at least partially received by the aperture of the container when the container is mounted to the engagement element. A vent aperture is formed in the engagement element and provides fluid communication between the channel and an area outside of the engagement element when the container is disengaged from the engagement element. The vent aperture is sealed, and the channel receives a flow of formulation from the container when the container is mounted to the engagement element.

17 Claims, 14 Drawing Sheets

(56) References Cited

U.S. PATENT DOCUMENTS

| | | | | |
|---|---|---|---|---|
| 11,311,098 | B2 | 4/2022 | Grez | |
| 11,470,940 | B2 | 10/2022 | Grez et al. | |
| 2006/0054634 | A1 | 3/2006 | Mekata | |
| 2009/0008415 | A1* | 1/2009 | Ohshima | B05B 11/1011 222/383.1 |
| 2014/0371690 | A1* | 12/2014 | Sprada | B05B 11/103 604/311 |
| 2018/0116363 | A1* | 5/2018 | Grez | A45D 24/28 |
| 2019/0098974 | A1* | 4/2019 | Grez | A45D 24/26 |

OTHER PUBLICATIONS

U.S. Appl. No. 18/757,928, titled "Formula Delivery Appliance With Anti-Clogging Mechanism," filed Jun. 28, 2024 (not provided).

International Search Report and Written Opinion mailed Sep. 26, 2024, issued in corresponding International Application No. PCT/US2024/035988, filed Jun. 28, 2024, 14 pages.

* cited by examiner

FORMULA DELIVERY APPLIANCE

CROSS-REFERENCES TO RELATED APPLICATIONS

This application claims the benefit of Provisional Application No. 63/511,252, filed Jun. 30, 2023. This application also claims priority to French Application No. 2309584, filed Sep. 12, 2023. The entire disclosures of both applications are hereby incorporated by reference herein for all purposes.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In an aspect, the present disclosure is directed to, among other things, representative embodiments of a formula delivery appliance. In one example, the formula delivery appliance is a hair coloring appliance having a consumable assembly. The embodiments described herein relate generally to hair and scalp treatment appliances. The consumable assembly of the appliance may be configured to incorporate various components of the hair and scalp treatment appliance, a portion of which may be consumed and then replaced by a user. In this regard, the consumable assembly may include one or more formulation delivery packets, nozzles, manifold chambers, distribution heads, and the like. The formula delivery appliance may also include a degassing feature that vents gases from the consumable assembly when mounted to a delivery device.

In accordance with one embodiment described herein, a formulation delivery appliance includes a container having an aperture and being configured to retain a volume of formulation. The delivery appliance further includes an elongate engagement element having a channel extending therethrough and being configured to be at least partially received by the aperture of the container when the container is mounted to the engagement element. A vent aperture is formed in the engagement element and provides fluid communication between the channel and an area outside of the engagement element when the container is disengaged from the engagement element. The vent aperture is sealed, and the channel receives a flow of formulation from the container when the container is mounted to the engagement element.

In accordance with any of the embodiments described herein, the container further includes a membrane covering the aperture of the container when the container is in a sealed condition.

In accordance with any of the embodiments described herein, the engagement element ruptures the membrane as the container is mounted to the engagement element, wherein piercing the membrane changes the container from a sealed condition to an unsealed condition.

In accordance with any of the embodiments described herein, the vent aperture is in fluid communication with the formulation when the engagement element is at least partially received within the aperture of the container.

In accordance with any of the embodiments described herein, the vent aperture is unsealed as the engagement element ruptures the membrane.

In accordance with any of the embodiments described herein, the container includes an end fitting defining the aperture.

In accordance with any of the embodiments described herein, the container further includes a sealing member in sealing engagement with the end fitting, the sealing member having a passageway extending therethrough and being in fluid communication with an interior portion of the container and with the aperture defined by the end fitting.

In accordance with any of the embodiments described herein, the engagement element sealingly engages the sealing member of the container when the container is mounted to the engagement element.

In accordance with any of the embodiments described herein, the sealing member seals the vent aperture when the container is mounted to the engagement element.

In accordance with any of the embodiments described herein, an engagement sealing member is mounted to the engagement element, the engagement sealing member providing sealing engagement between the engagement element and the end fitting when the container is mounted to the engagement element.

In accordance with any of the embodiments described herein, the engagement sealing member is an O-ring.

In accordance with any of the embodiments described herein, the formulation is selected from the group consisting of permanent hair dye, semi-permanent hair dye, developer, conditioner, hair growth treatment, ROGAINE®, hair protein treatment, disulfide bond repairing hair treatment, OLAPLEX®, fluid hair treatment, and fluid scalp treatment.

In accordance with any of the embodiments described herein, the formulation delivery appliance further includes a second container configured to retain a volume of a second formulation and a second elongate engagement element configured to be at least partially received by the second container. The formulation delivery appliance further includes a manifold configured to receive the first and second formulations from the first and second containers, respectively.

In accordance with any of the embodiments described herein, the formulation delivery appliance further includes a head assembly configured to receive a mixture of the first and second formulations from the manifold and to dispense the mixture to at least one of a user's hair and scalp.

In accordance with other embodiments described herein, a formulation delivery appliance includes a first container having a first aperture and being configured to contain a volume of a first formulation and a first elongate engagement element having a first channel extending therethrough and being configured to be at least partially received by the first aperture of the first container when the first container is mounted to the first engagement element. A first vent aperture is formed in the first engagement element and provides fluid communication between the first channel and an area outside of the first engagement element when the first container is disengaged from the first engagement element. The first vent aperture is sealed, and the first channel receives a flow of the first formulation from the first container when the first container is mounted to the first engagement element. The formulation delivery appliance further includes a pump in fluid communication with the first channel of the first engagement element to withdraw the first formulation from the first fluid container. The formulation delivery appliance further includes a head in fluid communication with the pump, the head being configured to discharge the first formulation.

In accordance with any of the embodiments described herein, the formulation delivery appliance further includes a second container having a second aperture and being configured to contain a volume of a second formulation. A second elongate engagement element has a second channel extending therethrough and is configured to be at least partially received by the second aperture of the second container when the second container is mounted to the second engagement element. A manifold is configured to mix the first and second formulations received from the pump and to provide a mixture of the first and second formulations to the head.

In accordance with any of the embodiments described herein, a second vent aperture is formed in the second engagement element and provides fluid communication between the second channel and an area outside of the second engagement element when the second container is disengaged from the second engagement element. The second vent aperture is sealed, and the second channel receives a flow of the second formulation from the second container when the second container is mounted to the first second engagement element.

In accordance with any of the embodiments described herein, the first formulation is a hair dye, and the second formulation is a developer.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
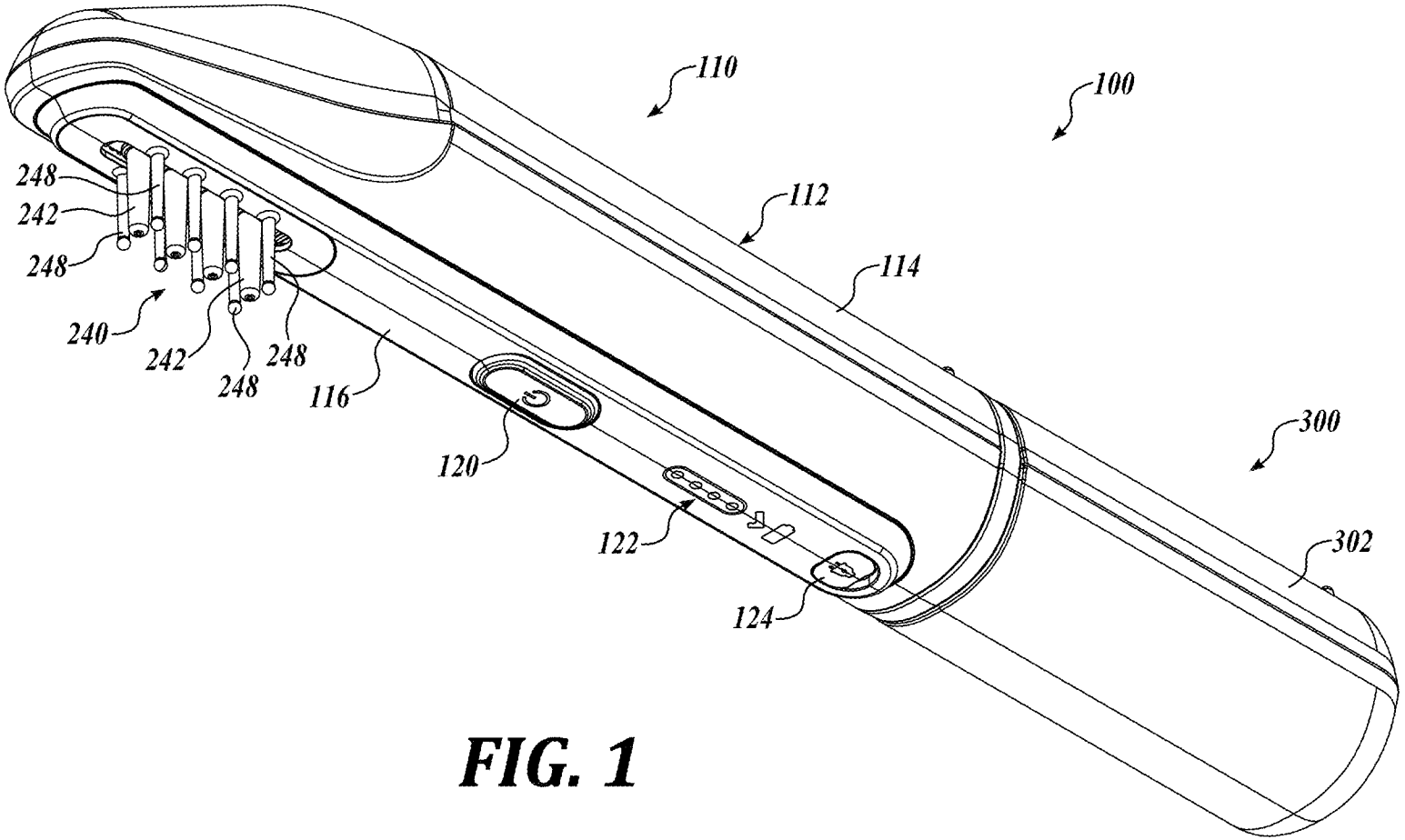
FIG. 1 is a perspective view of one representative embodiment of a formulation delivery appliance in accordance with an aspect of the present disclosure, wherein the appliance includes a consumable assembly mounted to a delivery assembly.

The following description provides several examples that relate generally to hair and scalp treatment applicators and formulation delivery appliances. Application of a wide variety of treatment formulations to human hair and scalp tissue is a common practice. In some instances, it is beneficial for the treatment formulation to be applied to a targeted portion of the hair or scalp tissue. In one example, applying a treatment formulation to a portion of the hair near the scalp may be desired, for instance, when applying a coloring dye to roots of hair during a color maintenance procedure. In another example, applying a treatment formulation directly to the scalp tissue, while minimizing contact with the hair, may be desired.

Existing systems for the application of hair and scalp treatment formulations have been widely used. In one example, hair coloring kits are generally used to change the appearance of the hair color or to blend gray hairs, among other uses. Existing hair coloring systems may utilize two or more components that are packaged separately and then mixed on demand by the system to provide a treatment formulation that is applied to the hair. In some examples, these components are stored separately within sealed containers prior to being mounted within the application systems. When the containers are mounted within the application system, the containers are ruptured so that the components stored therein can be extracted, mixed together, and applied by the user.

Examples of treatment formulations applied by the embodiments herein include but are not limited to: permanent hair dye; semi-permanent hair dye; developer; conditioner; hair growth treatment, such as minoxidil manufactured under the trade name ROGAINE®; hair protein treatment; disulfide bond repairing hair treatment, such as OLAPLEX®; fluid hair treatment; fluid scalp treatment, and the like. Although any hair and scalp treatment formulation is suitably applied using the embodiments of the appliance described herein, the present disclosure generally refers to hair coloring formulation as the example of treatment formulation applied by the appliance described below. However, it should be appreciated that any of the listed hair and scalp treatment formulations are interchangeable with the coloring formulation described herein.

The following discussion provides examples of systems, apparatuses, and/or appliances of a formula delivery device that is configured to apply treatment formulation to a targeted area of the hair and/or scalp. The appliance of the present disclosure generally includes a delivery device configured to be grasped by the hand of a user, and a head having a plurality of nozzles from which the coloring formulation is discharged. In some embodiments, the head may further include a plurality of standoff protrusions near the nozzles to space the orifice of the nozzle away from the scalp during use. In other embodiments, the nozzles may move during use, for example, by reciprocating or oscillating motion, such that the nozzles can deliver more thorough coverage of the treatment formulation.

Examples of the above-described systems are disclosed by U.S. Pat. No. 11,470,940, ("the '940 patent"), issued to Grez, the disclosure of which is incorporated herein in its entirety. The '940 patent teaches the application of air coloring formulations that typically includes at least one dye and a separate developer that must be mixed in controlled proportions for effective and predictable results. As used in the '940 patent and in the present application, the term "coloring formulation" refers generally to any of the dye, developer, formulation, fluid, or any mixture thereof.

Some components of the coloring formulation are known to generate gas over time. As a result, a sealed container filled with coloring formulation can be at least partially filled with gas that is produced between the time at which the container is initially sealed and the time at which the coloring formulation is used. The mix ratio of a coloring formulation can be important to the safety and effectiveness of a hair coloration systems, and gas produced by the coloring formulation when sealed in the container can affect this ratio. In known embodiments, an apparatus can be initially operated to dispense coloring formulation along with any built-up gas prior to applying the coloring formulation to the hair. However, such configurations waste coloring formulation.

By use of the embodiments of the present disclosure, gases that have built up in sealed containers of coloring formulations are evacuated when the containers are initially connected to the apparatus. As such, the desired mix ratio of the coloring formulation automatically maintained without wasting coloring formulation.

Although the formula delivery device 100 and the other exemplary embodiments are described and illustrated as being used with a plurality of nozzles, it should be appreciated that the formula delivery devices shown and described herein may be used with any suitable formulation applicator configuration and for any suitable use.

FIGS. 1-7 show a representative embodiment of a formula delivery device 100 according to aspects of the present disclosure. The formula delivery device 100 is shown as an appliance having a delivery assembly 110 and a consumable assembly 300. Accordingly, the formula delivery device 100 will be referred to hereinafter as an appliance 100.

As will be described in further detail, an embodiment of the consumable assembly 300 includes two or more formulation containers 308 and 314, the interiors of which are in fluid communication with a pump 190 via a coupler 140. The pump 190 draws formulation from each of the formulation containers 308 and 314 and discharges the formulations to a manifold 210. The formulations are mixed by static mixers as they pass through the manifold 210 and are then discharged through a head 240 to be applied to the hair and/or scalp of a user.

Referring to the cross-sectional views of FIGS. 3, 7, and 8, the consumable assembly 300 will now be described. The consumable assembly 300 enables a user to replace depleted coloring formulation containers and/or to utilize different coloring formulations with the delivery device. In this regard, the consumable assembly 300 is configured to be demountably coupled to the delivery assembly 110 to form the appliance 100. In the illustrated embodiment, the consumable assembly 300 includes an elongate housing 302 sized and configured to be received with the cavity 118 of the housing 112 of the delivery assembly 110 to mount the consumable assembly to the delivery assembly.

The consumable assembly 300 is configured to be removably received within the cavity 118 of the delivery assembly 110 such that the delivery assembly and the consumable assembly cooperate to form the appliance 100. In the illustrated embodiment, the housing 302 of the consumable assembly 300 includes a release button 304 that engages a detent feature 126 formed on the housing 112 of the delivery assembly 110 to releasably secure the consumable assembly to the delivery assembly when the consumable assembly is mounted thereto (see FIG. 3). To release the release button 304 from the detent feature 126, a user presses the release button 304 to disengage the release button from the detent feature, thereby enabling removal of the consumable assembly from the delivery assembly 110. In other embodiments, other securing configurations are suitably used, such as press-fit, fasteners, hook and loop, releasable adhesive, magnets, and the like. Additional securement features are also within the scope of the present disclosure, such as a lower detent, which may provide a greater securement force between the consumable assembly 300 and the delivery assembly 110. In other embodiments, any number or combination of securement features are suitably used to secure the consumable assembly 300 to the delivery assembly 110.

Figure 3:
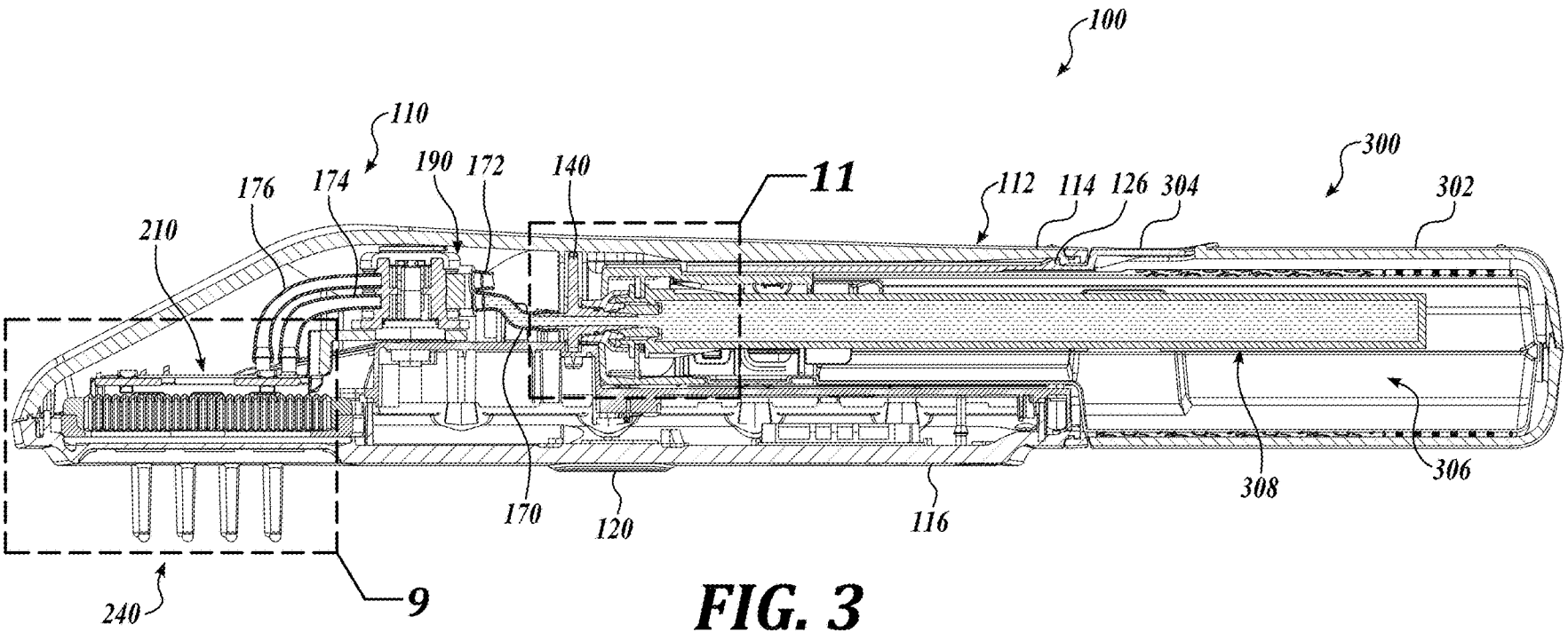
FIG. 3 is a cross-sectional side view of the appliance of FIG. 1.
Figure 7:
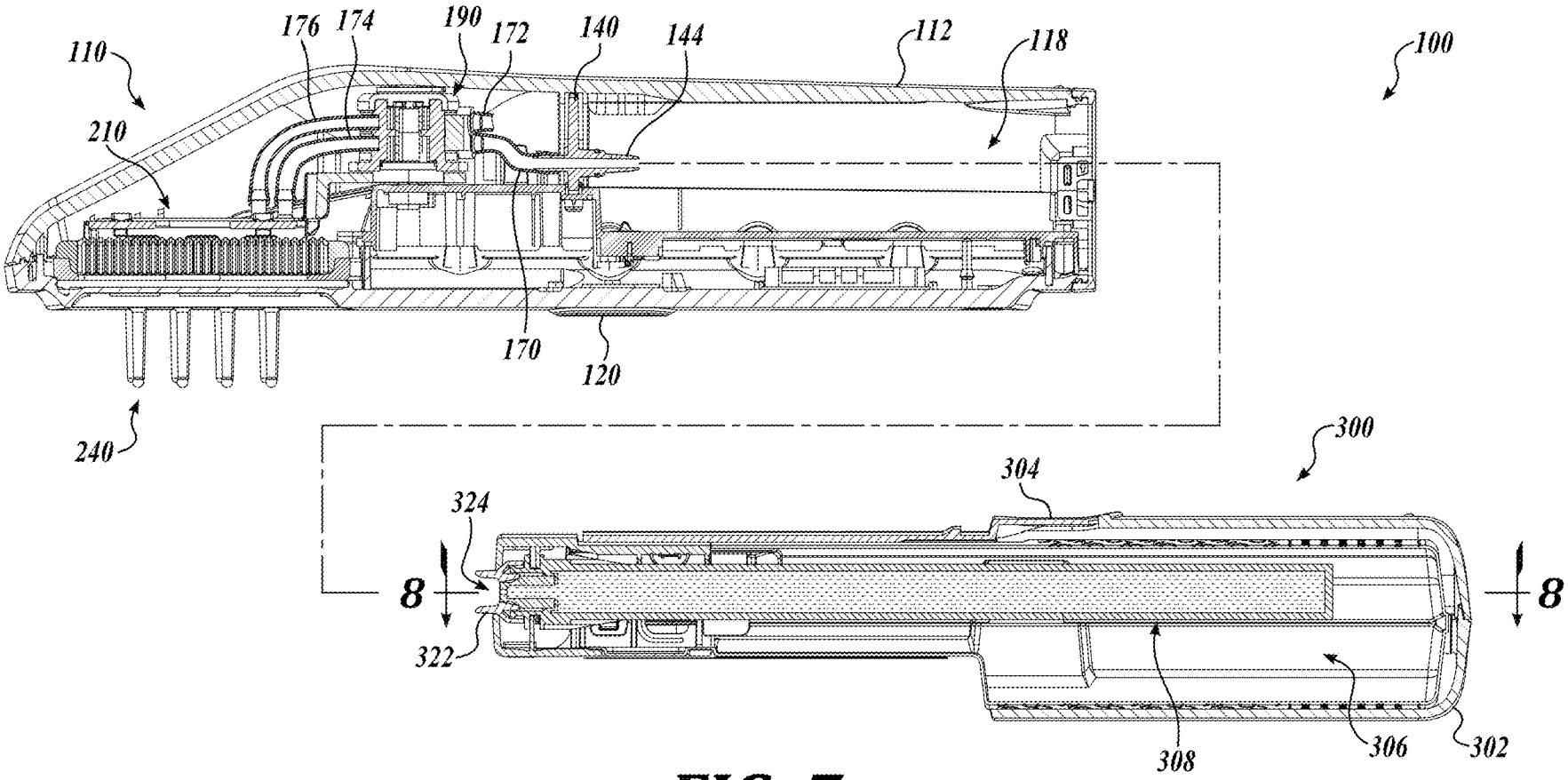
FIG. 7 is a cross-sectional side view of the appliance of FIG. 4.
Figure 8:
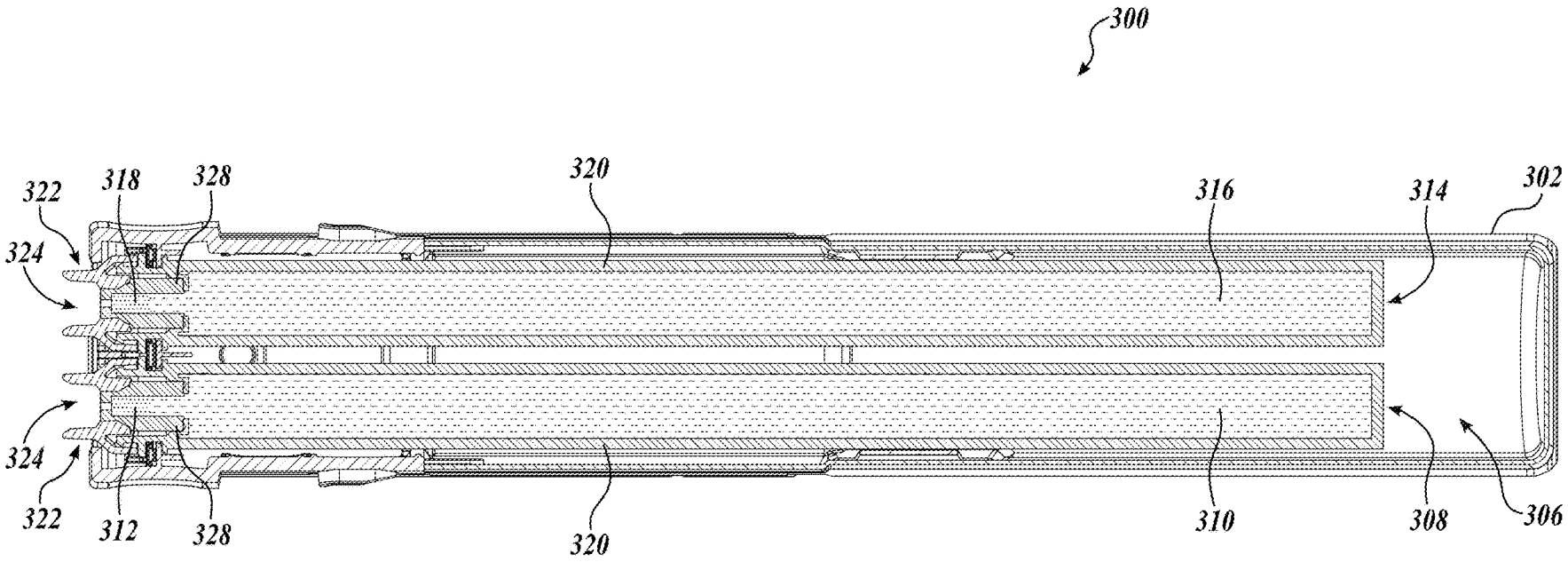
FIG. 8 is a cross-sectional plan view of the consumable assembly of the delivery assembly as indicated in FIG. 7.

Still referring to FIGS. 3, 7, and 8, the consumable assembly 300 includes a first formulation container 308 and a second formulation container 314 disposed within the cavity 306 of the housing 302. The first and second formulation containers 308 and 314 contain first and second formulations containers 308 and 314, respectively. In some embodiments, the first formulation container 308 includes a coloring formulation such as a coloring dye, and the second formulation container 314 contains a developer. In other embodiments, a single formulation container with a coloring formulation is suitably used.

The use of a developer with the coloring dye formulation provides a more lasting coloring effect, up to about one month. The combination of coloring dye and developer is generally referred to as permanent coloring, while applying a dye without use of the developer results in a semi-permanent coloring, usually lasting about a week. The developer can be used with a single formulation container or with multiple formulation containers.

The first formulation container 308 will now be described with the understanding that the second formulation container 314 is similarly configured and, in some embodiments, contains a second formulation 316 that is different than the first formulation 310 contained with the first formulation container 308. The first formulation container 308 includes a packet 320, i.e., a reservoir, configured to be filled with a first formulation 310. In some embodiments, the packet 320 is a flexible pouch. In some embodiments, the packet is a rigid or semi-rigid container.

As best shown in FIGS. 11-14, the formulation container 308 further includes an end fitting 322 mounted to one end of the packet 320 and configured to interface with the coupler 140, described below. In this regard, the end fitting 322 includes an aperture 324 sized and configured to receive an engagement element 144 of the coupler 140 when the consumable assembly 300 is mounted to the delivery assembly 110 so that the engagement element extends into the formulation container 308. The end fitting 322 further includes a stop 326 formed thereon that engages the coupler 140 to limit movement of the engagement element 144 into the formulation container 308.

Figure 11:
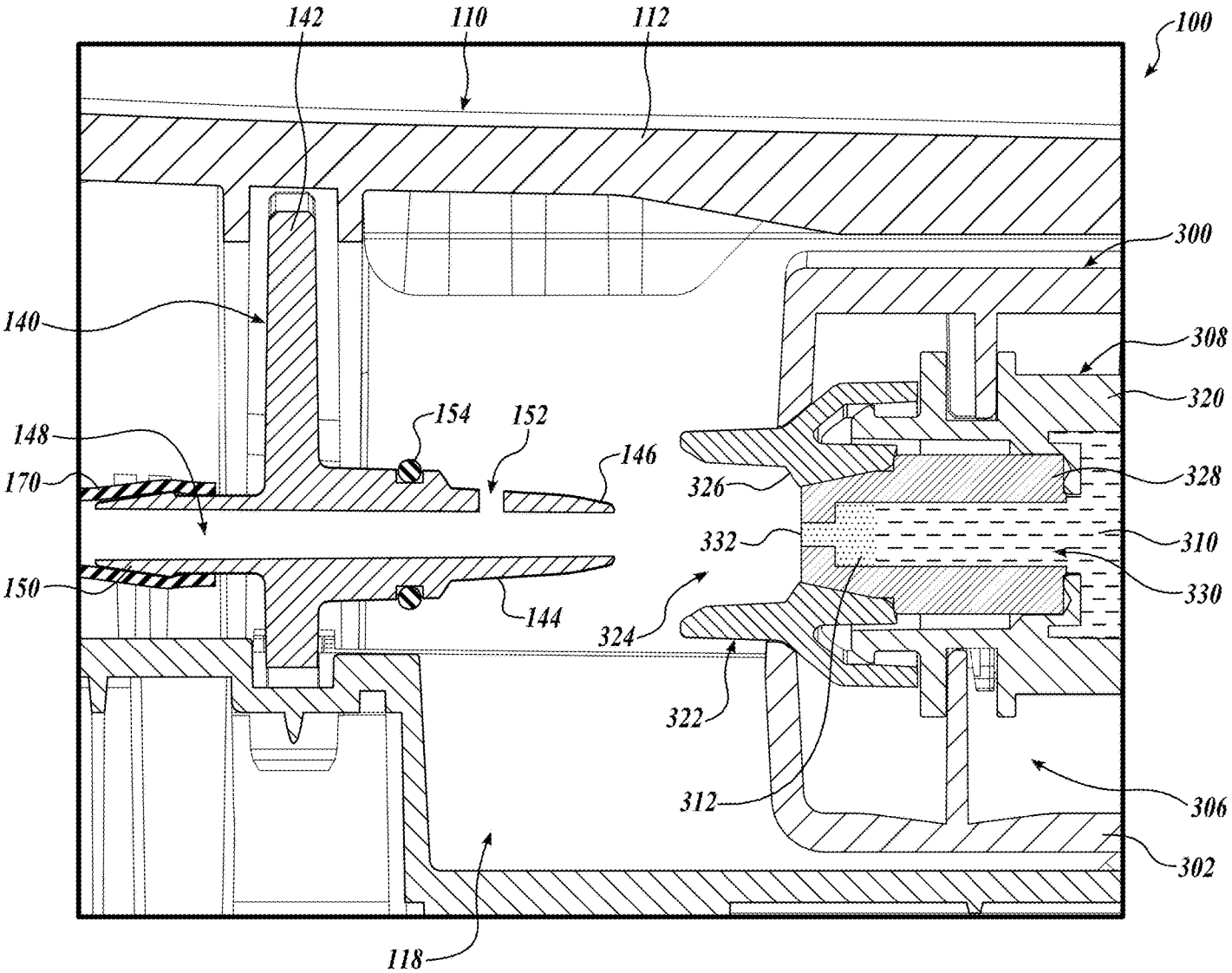
FIG. 11 is a partial side view of the appliance as indicated in FIG. 3, wherein the consumable assembly is being mounted to the delivery assembly, and an end fitting of the consumable assembly has not yet engaged a coupler of the delivery assembly.
Figure 12:
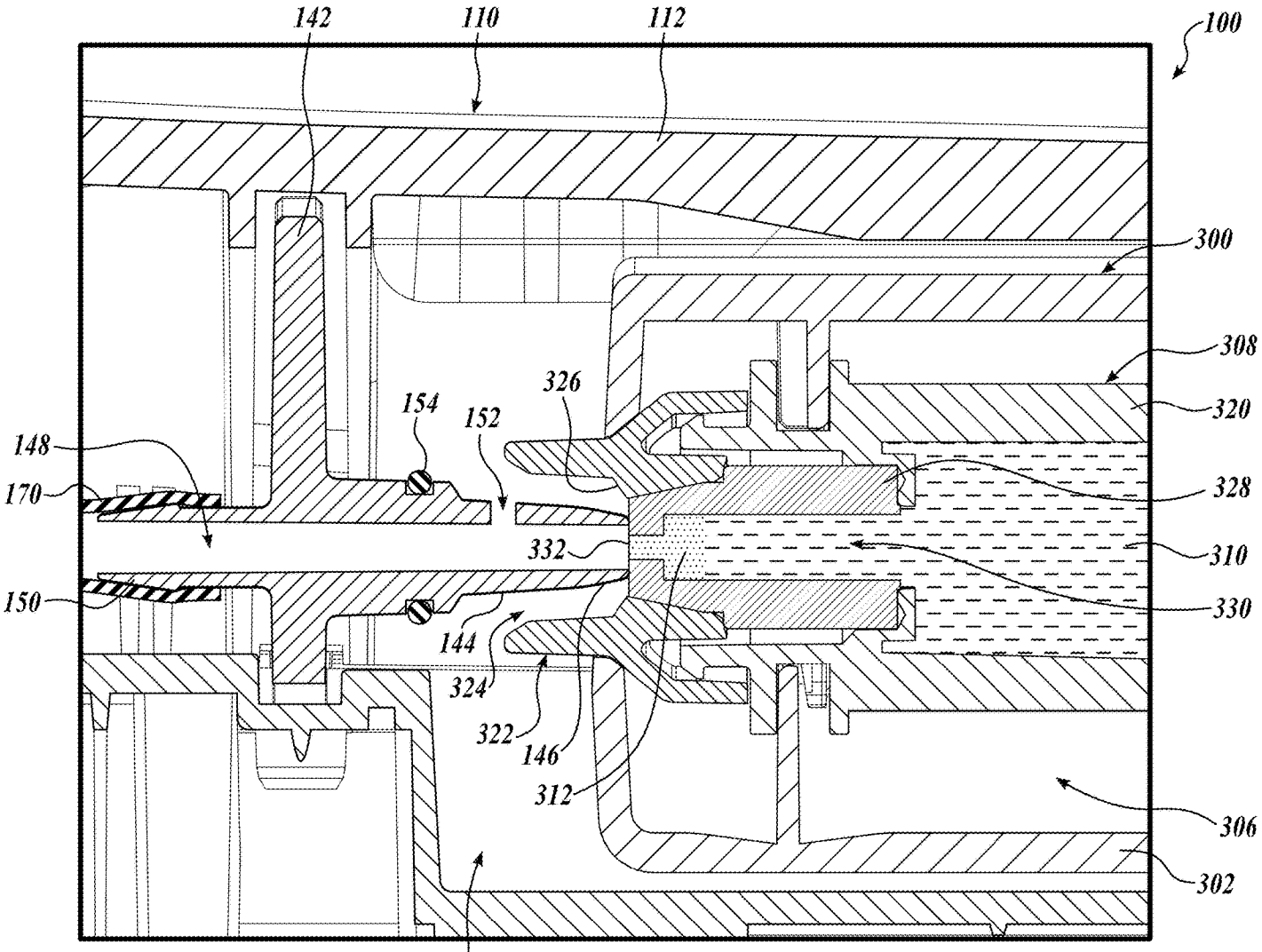
FIG. 12 is a partial side view thereof, wherein the coupler has made initial contact with the end fitting.

A sealing member 328 is positioned between the end fitting 322 and the packet 320. An aperture 330 extends through the sealing member 328 and is sized and configured to receive an engagement element 144 of the coupler 140 in sealing engagement when the consumable assembly 300 is mounted to the delivery assembly 110. As shown in FIGS. 11 and 12, a membrane 332 covers one end of the aperture 330. The membrane 332 in combination with the sealing engagement of the sealing member 328 with both the packet 320 and end fitting 322 seals the packet so that the formulation 310 contained in the packet is isolated from the ambient environment. In some embodiments, the membrane 332 is a one-way or two-way breathable membrane configured to allow outgassing of the packet 320 without the ingress of contaminants or the egress of the contents of the packet. Still, in further embodiments, the sealing member 328 includes a valve (not shown), used in conjunction with any of the embodiments herein, the valve being configured to regulate the flow of the fluid from the packets 320. Any combination of the above features may also be used.

Figure 2:
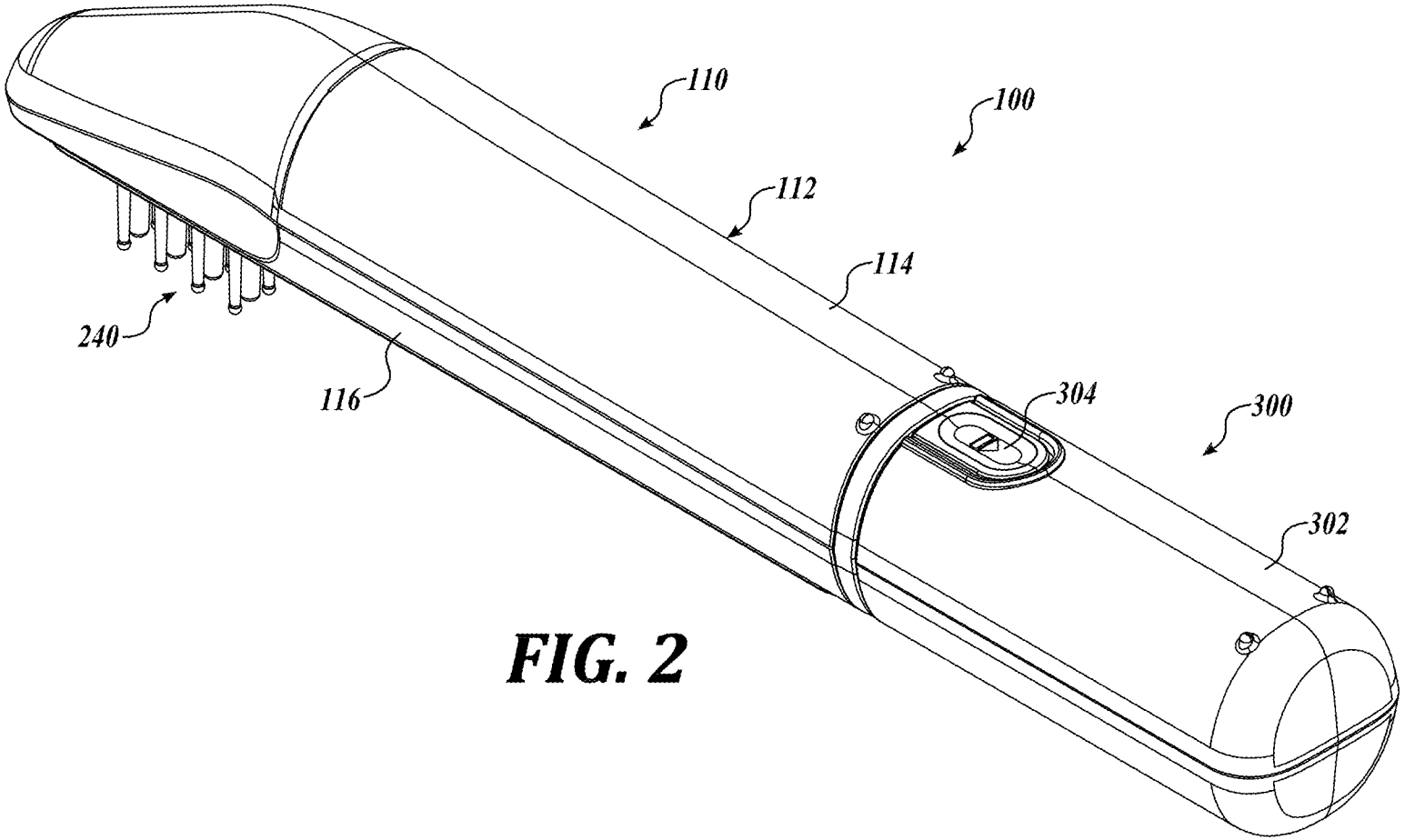
FIG. 2 is another perspective view of the appliance of FIG. 1.

The delivery assembly 110 will now be described in greater detail. The housing 112 of the delivery assembly 110 is generally configured to house and enclose various components of the delivery assembly 110, which will be described in greater detail below. As shown in FIGS. 1-3, the housing 112 includes a control button 120, a power indicator 122, and port 124. The housing 112 provides a surface for a user to grasp with a hand while using the appliance 100. In this regard, the housing 112 is ergonomically shaped in the illustrated embodiments. However, in other embodiments, the housing 112 is suitably any shape to contain the internal components and provide one or more gripping surfaces for the user. In further embodiments, the consumable assembly 300 may form at least part of the gripping surfaces for the user. In the illustrated embodiments, the housing 112 includes a first housing portion 114 and a second housing portion 116 coupled to each other to at least partially define a cavity 118 therein (see FIG. 5). In further embodiments, the housing 112 has a unitary construction or includes three or more portions coupled together to at least partially define a cavity.

The housing 112 houses various appliance control components, such as one or more of a pump 190 (see FIG. 3), a motor that drives the pump 190, a CPU, a battery, a communications system (such as wireless networking (Wi-Fi), Radio Frequency Identification (RFID), Near Field Communication (NFC), BLUETOOTH®, and the like), an electric and data connector at the port 124 (such as Universal Serial Bus (USB), Firewire, or the like), temperature sensors, accelerometers, fluid sensors, data scanners, light sources, audible signal generator, fluid heating sources, temperature controllers, and other suitable control components, which are not shown in the FIGURES for simplicity. In some embodiments, the port 124 is suitably used to provide an interface between the internal control components of the appliance 100 and external components/systems, and/or charge the battery of the appliance 100.

The control button 120 may be configured for activating, deactivating, and controlling features of the appliance 100. In some embodiments, pressing the control button 120 powers on the appliance 100 such that coloring formulation is drawn from the formulation containers 308 and 314 (see FIG. 8). In these embodiments, releasing the control button 120 may stop the flow of coloring formulation. In certain examples, the control button 120 may be used to initialize the appliance 100 or place the appliance 100 in a state to perform certain functions, such as one or more of: calculating a mixture ratio of the components of the coloring formulation; entering a cleaning or purging mode; heating the formulation; gathering data from the formulation containers, such as volume remaining, mixture ratios, color information, etc.; sending and receiving signals through the port 124; analyzing data regarding user preferences; gathering data from sensors; providing status indication to the user, such as power output level, battery life, formulation volume remaining, sensor data, data connection information, etc.; and communicating with auxiliary equipment. In some embodiments, the control button 120 is capable of pressure sensitive operation, such that applying a higher pressure to the control button 120 causes a variable response, such as, for example, causing the formulation to flow faster, the nozzles to move faster, or the like. In some embodiments, various operating parameters can be controlled by the use of a smart device, such as a phone (as described in detail in U.S. Pat. No. 10,694,832, issued to Grez, which is incorporated by reference herein).

Referring to FIGS. 3, 6, and 11-14, the coupler 140 is mounted within the housing 112 and is configured to engage the interior portions of the formulation containers 308 and 314 so that the formulations 310 and 316, respectively, contained therein can be drawn out for application to the user. The coupler 140 includes a base 142 mounted within the housing 112 of the delivery assembly 110. A pair of elongate engagement elements 144 extends from the base 142 into the cavity 306, and each engagement element terminates at a tip 146 opposite the base 142. Each engagement element 144 is sized and positioned to extend through an aperture 324 of the consumable assembly 300 into one of the formulation containers 308 and 314 when the consumable assembly 300 is mounted to the delivery assembly 110.

As best shown in FIGS. 11-14, each engagement element 144 has a channel 148 that extends through the element to a port 150 formed on the opposite side of the base 142. Each engagement element 144 may further include a sealing element 154, such as an O-ring, mounted to the exterior surface of the engagement element. The sealing element 154 is sized and configured to sealingly engage an interior surface of the corresponding aperture 330 through which the sealing element extends when the consumable assembly 300 is mounted to the delivery assembly 110. One or more apertures 152 (vent apertures) extend radially through a portion of the engagement element 144 between the sealing element 154 and the tip 146 of the engagement element.

For each port 150 on the coupler 140, a formulation tube is attached at one end to the port and at the second end to the pump 190. In this regard, each formulation tube provides fluid communication between one of the ports 150 and an inlet of the pump 190. In the illustrated embodiment, the consumable assembly 300 includes two formulation containers 308 and 314, each having a corresponding aperture 324. The coupler 140 includes two elongate elements 144, each elongate element corresponding to one of apertures 324 the formulation containers 308 and 314. A first formulation tube 170 is mounted at one end to a port 150 of the coupler 140 and at a second end to a first inlet of the pump 190. Similarly, a second formulation tube 172 is mounted at one end to the other port 150 of the coupler 140 and at a second end to a second inlet of the pump 190. As a result, when the consumable assembly 300 is mounted to the delivery assembly 110, the interior of the first formulation container 308 is in sealed fluid communication with the first inlet port of the pump, and the interior of the second formulation container 314 is in sealed fluid communication with the second inlet port of the pump 190.

In other embodiments, the consumable assembly 300 includes any suitable number of formulation containers. For such embodiments, the coupler 140 includes a corresponding number of engagement elements and ports so that each engagement element engages one of the formulation containers, and each port is in fluid communication with an inlet port of the pump 190 through a formulation tube. As a result, the interior of each formulation container is in sealed communication with an inlet port of the pump. In some embodiments, the delivery assembly 100 includes more than one pump, wherein each pump is in sealed fluid communication with the interior of one or more formulation containers through corresponding engagement elements and formulation tubes.

The pump 190 is driven by a suitable motor (not shown) and is configured to draw coloring formulations 310 and 316 from formulation containers 308 and 314, respectively, through formulation tubes 170 and 172, respectively. In some embodiments, the pump 190 includes a number of discharge ports corresponding to the number of inlets. Each discharge port is in fluid communication with a corresponding inlet port on the manifold 210. In the illustrated embodiment, a first discharge port (not shown) discharges the first formulation component 310 received from the first formulation container 308 to a first manifold inlet port 214 of the manifold 210, and a second discharge port (not shown) discharges the second formulation component 316 received from the second formulation container 314 to a manifold second inlet port 216 of the manifold. In this regard, (referring to FIGS. 3 and 9), the first pump discharge port is in sealed fluid communication with the first manifold inlet port 214 by a first discharge tube 174, and the second pump discharge port is in sealed fluid communication with the second manifold inlet port 216 by a second discharge tube 176.

In some embodiments, a peristaltic pump 190 is used. In this regard, one advantage of a peristaltic-type pump is that the pump is self-priming. However, in other embodiments, any suitable pump, or series of pumps, is used to draw the coloring formulation from the formulation containers 308 and 314 to the manifold 210.

Figure 9:
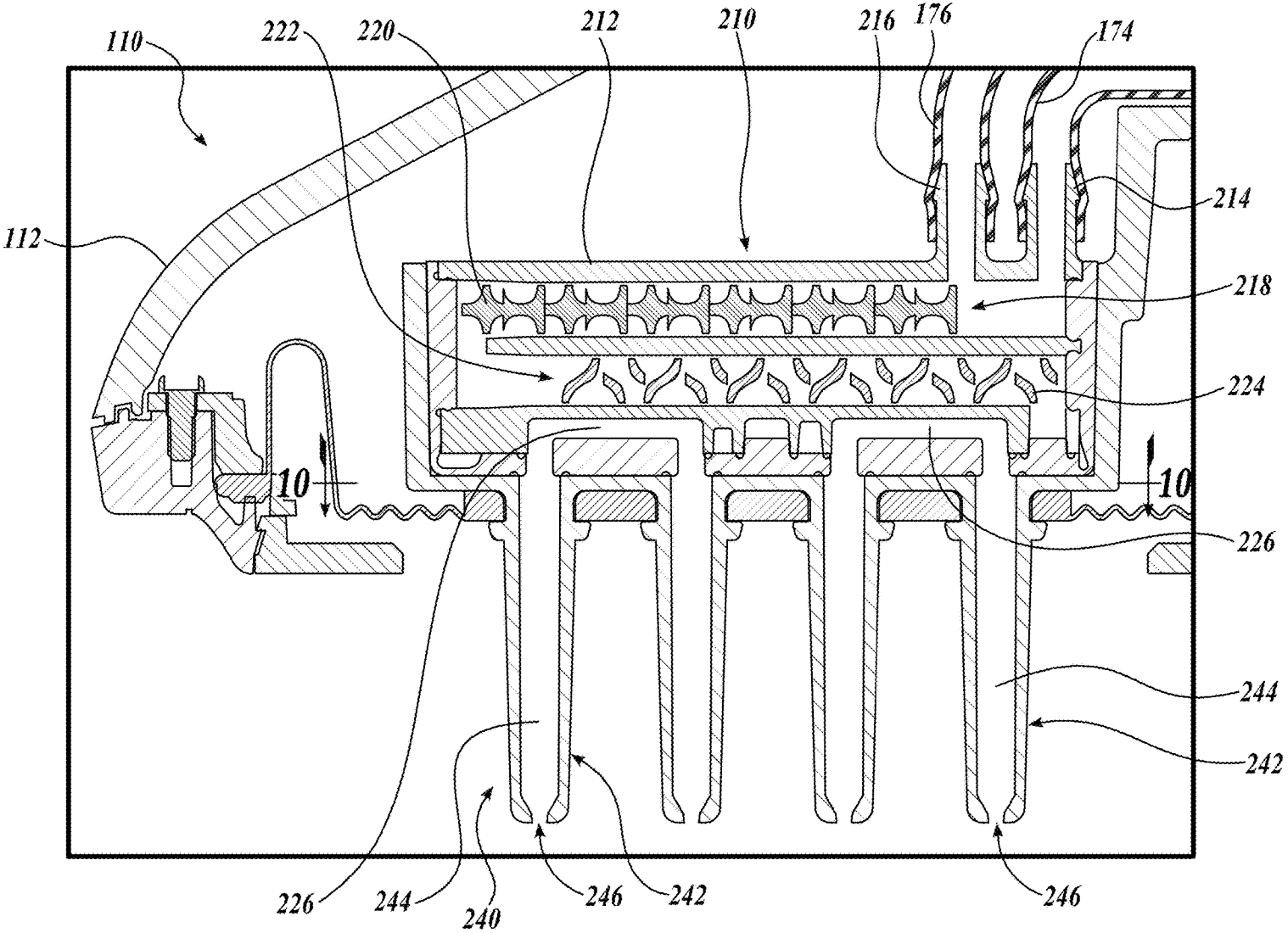
FIG. 9 is a cross-sectional side view a portion of a head and a manifold of the delivery assembly as indicated in FIG. 3.
Figure 10:
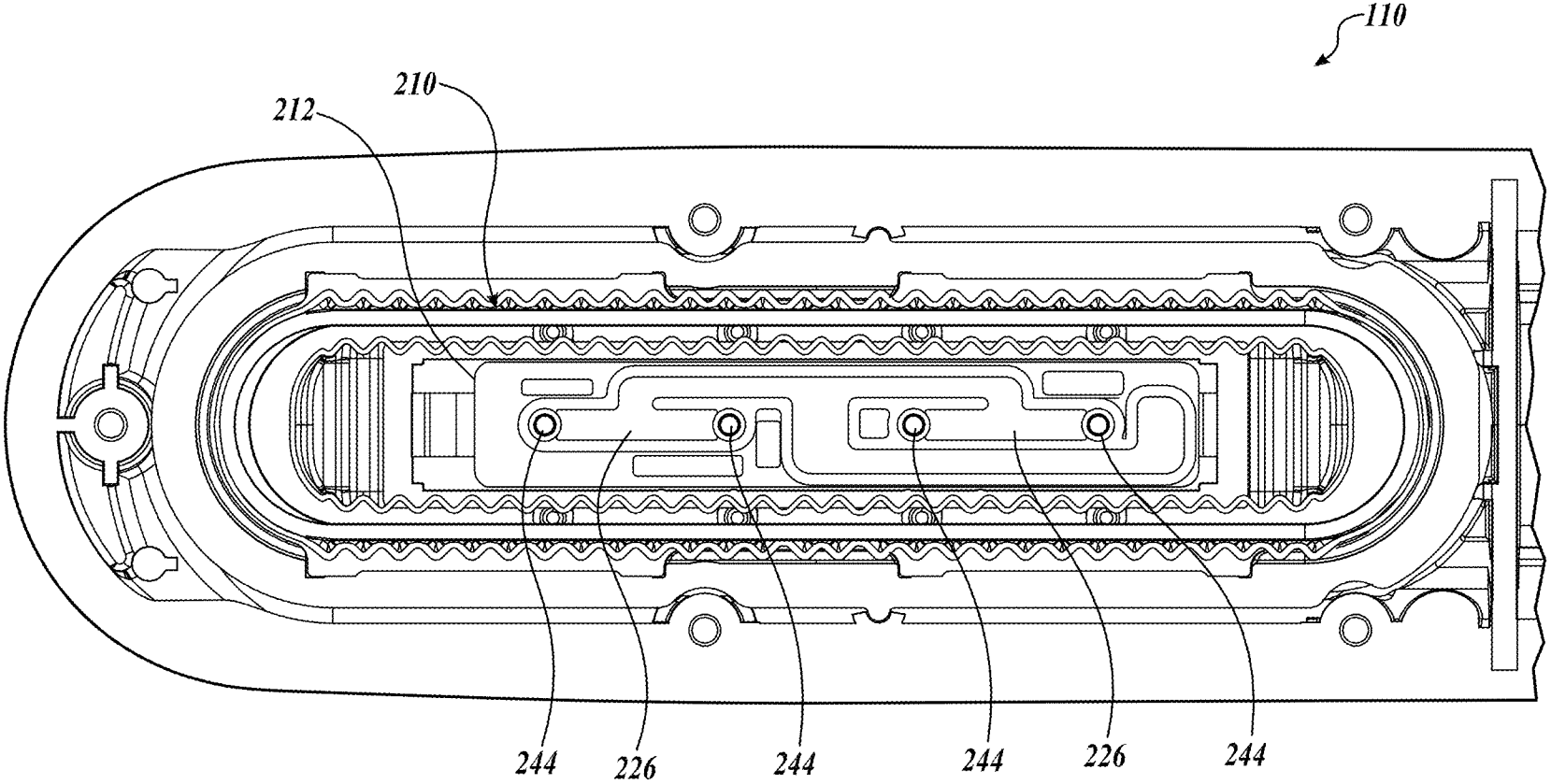
FIG. 10 is a cross-sectional plan view of a portion of the manifold, as indicated in FIG. 9.

Referring now to FIGS. 9 and 10, the manifold 210 receives coloring formulations 310 and 316 from the pump 190 and mixes the components as the coloring formulations move toward the head 240. In this regard, the manifold housing 212 includes a plurality of chambers for the mixing, processing, and discharge control of the coloring formulations from the formulation containers 308 and 314.

In an embodiment, the manifold 210 includes a housing 212 that has a first mixing chamber 218 arranged in seriatim with a second mixing chamber 222. The first mixing chamber 218 receives coloring formulations 310 and 316 from the pump through the first and second inlet ports 214 and 216, respectively. A static mixer 220 is disposed within the first mixing chamber 218 and mixes the coloring formulations 310 and 316 as they travel through the first mixing chamber. The coloring formulations 310 and 316 next move through the second mixing chamber 222 and are further mixed by a second static mixer 224 disposed therein. The mixed coloring formulations 310 and 316 then move through distribution channels 226 that distribute the mixture to the nozzles 242 of the head 240.

Figure 4:
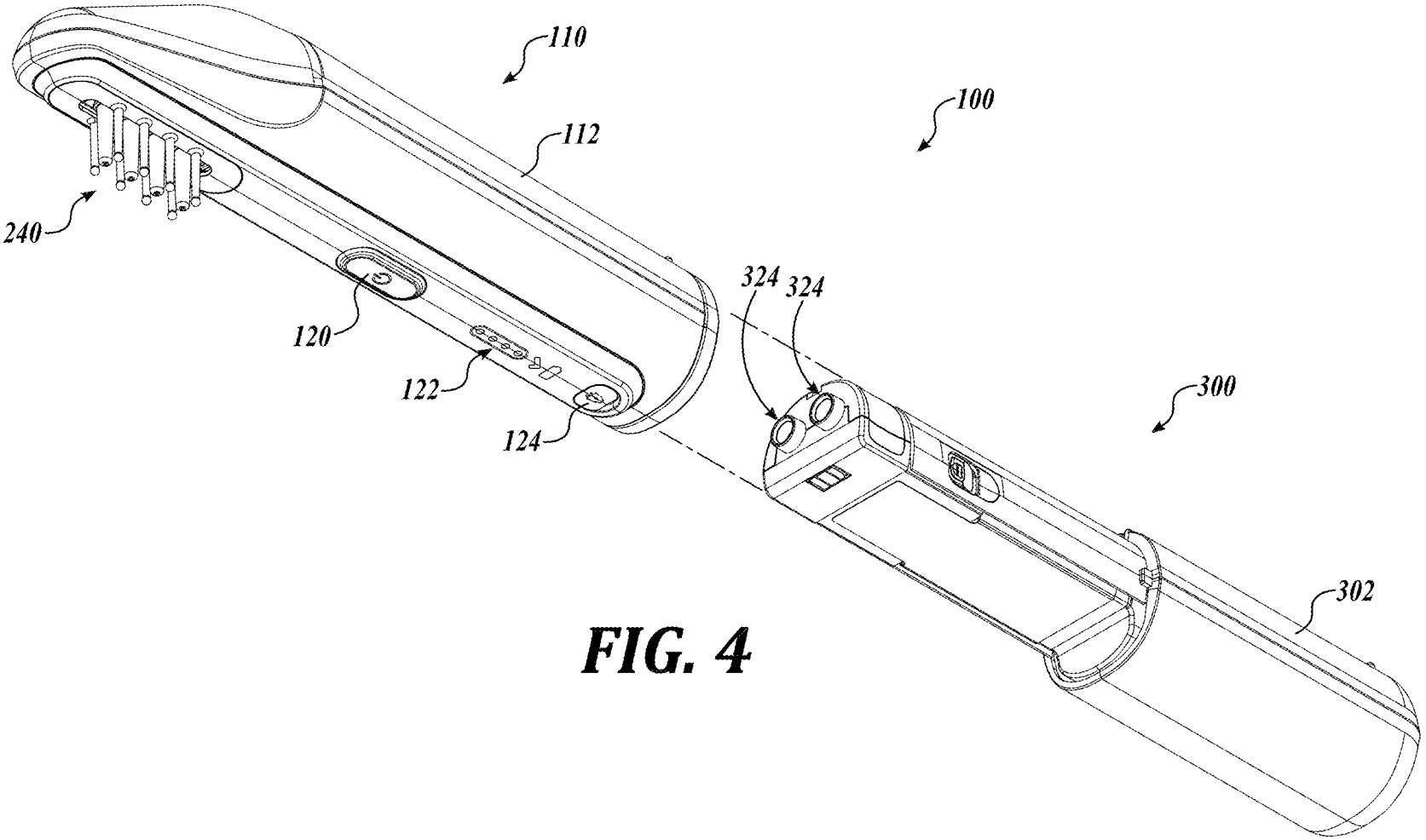
FIG. 4 is a partially exploded perspective view of the appliance of FIG. 1, wherein the consumable assembly is disengaged from the delivery assembly.
Figure 5:
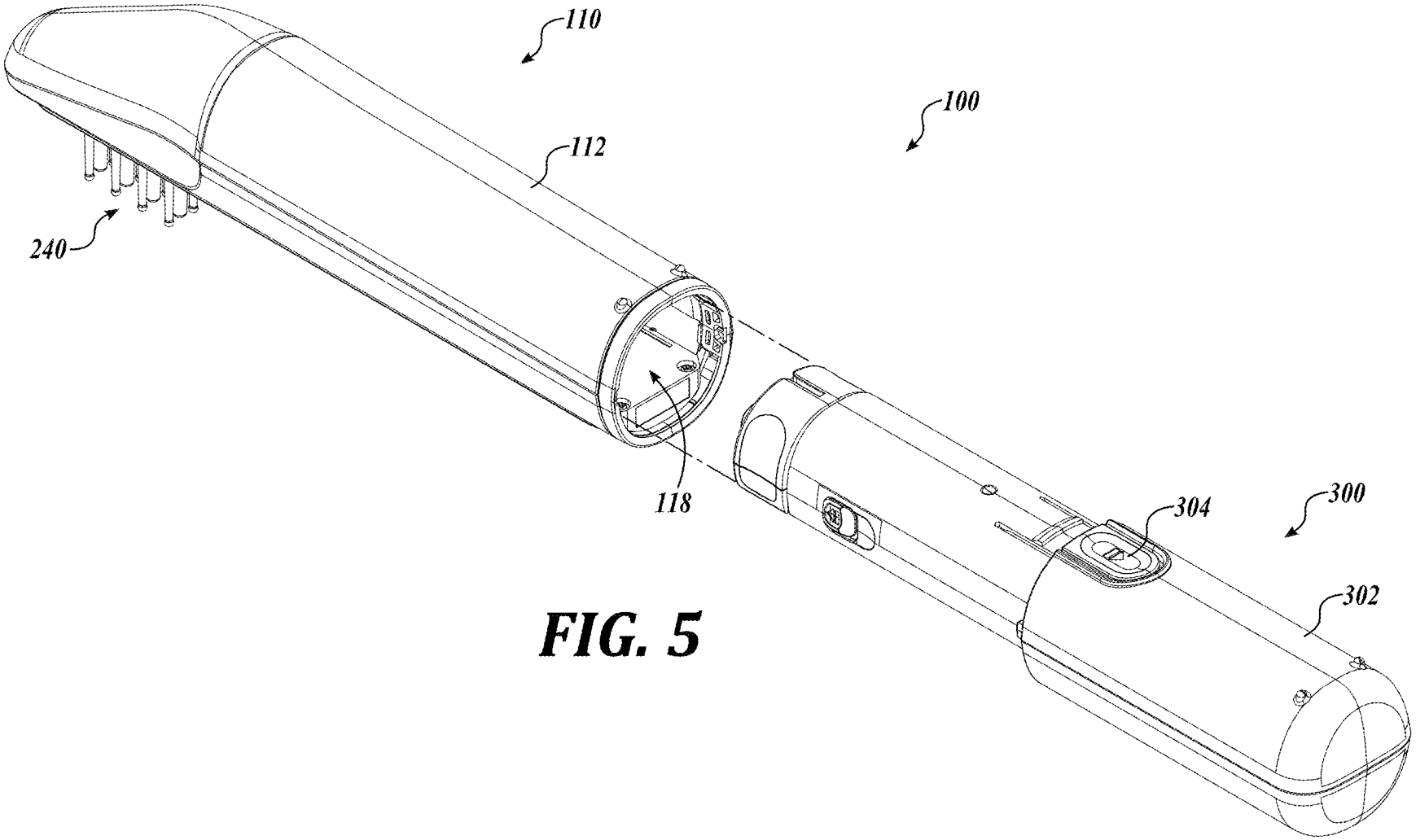
FIG. 5 is another partially exploded perspective view of the appliance of FIG. 4.
Figure 6:
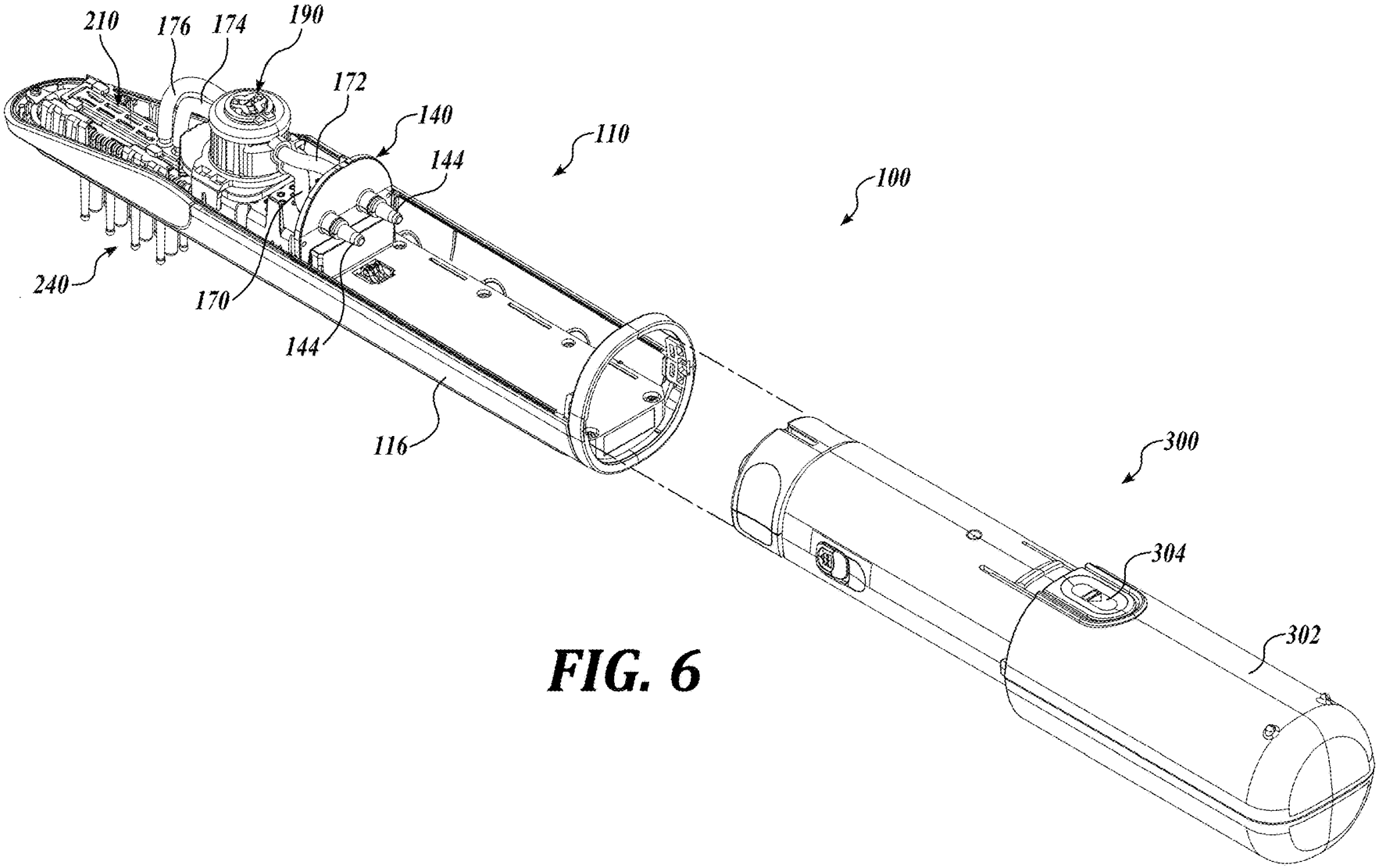
FIG. 6 is a another partially exploded perspective view of the appliance of FIG. 4, wherein a portion of the delivery assembly housing is removed.

The head 240 has a plurality of elongate nozzles 242 extending from the manifold 210. Each elongate nozzle 242 includes a channel 244 extending therethrough and configured to discharge coloring formulation received from the manifold 210 out through one or more outlet apertures 246 in the end of the nozzle 242 when the appliance 100 is being used. In some embodiments, the nozzles 242 are arranged in one or more rows along a portion of the housing 112 of the delivery assembly 110, generally in a direction along the length of the appliance 100, as shown in the (FIGS. 1, 4, and 9). In other embodiments, the nozzles 242 are suitably placed at an angle with respect to the length of the appliance 100.

In some embodiments, the nozzles 242 have a length between about 0.5 cm and about 4.0 cm from the manifold 210 to the end of the nozzles 242 at the outlet apertures 246. In other embodiments, the nozzles 242 have a length between about 1.4 cm and about 1.8 cm from the manifold 210 to the end of the nozzles 242 at the outlet apertures 246. In other embodiments, the nozzles 242 have a length of about 1.6 cm from the manifold 210 to the end of the nozzles 242 at the outlet apertures 246. In further embodiments, any length of nozzle is suitably used.

In the illustrated embodiment, a plurality of standoff protrusions 248 extend outwardly substantially in the direction of the nozzles 242 from the housing 112 in one or more rows. In this regard, substantially in the direction of the nozzles 242 refers to within an angle of about 25 degrees of the direction along the length of the nozzles 242. In the depicted embodiment, first and second rows of protrusions 248 are positioned along each side of a single row of elongate nozzles 242. In some embodiments, the standoff protrusions 248 may be disposed at an angle relative to the plurality of nozzles 242. (For example, see FIG. 4 of U.S. patent application Ser. No. 15/339,551, which is incorporated by reference herein.)

In some embodiments, each of the standoff protrusions 248 has a length (measuring between housing 112 to an end of the standoff protrusion 248) such that the end of the standoff protrusion 248 and the outlet apertures 246 of the nozzles 242 are substantially coplanar. In other embodiments, the standoff protrusions 248 have a length (from the housing 112 to the end of the standoff protrusion 248) such that the standoff protrusions 248 are longer than a length of the nozzles 242 (measuring between the housing 112 to an end of the nozzles 242). In this regard, during use, the standoff protrusions 248 would contact an application surface, such as a localized portion of the scalp, and space the outlet aperture 246 of the nozzles 242 away from the application surface to provide a gap for discharge of the coloring formulation through the outlet aperture 246. In embodiments in which the standoff protrusions 248 are longer than the plurality of nozzles 242, the standoff protrusions 248 are between about 0.1 mm and 5.0 mm longer than the length of each of the plurality of nozzles 242. In other embodiments, the standoff protrusions 248 are between about 0.5 mm and 1.5 mm longer than the length of each of the plurality of nozzles 242. In other embodiments, the standoff protrusions 248 are about 1.0 mm longer than the length of each of the plurality of nozzles 242.

The plurality of nozzles 242 extend from a surface of the manifold housing 212 such that portions of the hair of a user pass between the plurality of nozzles 242 as the user passes the appliance 100 over the surface, e.g., the scalp. In some embodiments, the plurality of nozzles 242 is configured to reciprocate by reciprocation of the manifold 210 along the direction of the row of the plurality of nozzles 242. In this regard, the manifold housing 212 translates with respect to the housing 112 so that the coloring formulation to cover areas of the surface between each of the nozzles 242 as the appliance 100 is passed over the surface in a direction perpendicular to the row of the plurality of nozzles 242. As a result, the full surface below the plurality of nozzles 242 can be covered by the coloring formulation without having to overlap passes of the appliance 100 on the surface. In other embodiments, the nozzles 242 of the appliance are configured to oscillate, reciprocate along the length of the nozzles 242, vibrate, or remain stationary during use. Embodiments of reciprocating heads are described in '940 patent.

As noted above, in some embodiments, an energy source, (e.g., a heat source, not shown) may be added to any location in the path of the coloring formulation flow to raise the temperature of the formulation, or it may be added to the appliance 100 such that the heat is transferred to the application surface, e.g., the scalp. In this regard, for certain formulations, it may be beneficial in either user comfort, formulation efficacy, or both, to apply the formulation to the user at an elevated temperature, or to heat the application surface. In these embodiments, the heat source is configured to deliver energy to the formulation or the application surface. In some embodiments, the energy source is an ultraviolet radiation source configured to illuminate the plurality of nozzles 242 to transfer ultraviolet radiation to the application surface, such as to hair roots and/or scalp tissue. In other embodiments, the energy source is a heat source configured to heat the formulation prior to discharge from the plurality of outlet nozzles 242.

As previously discussed, some coloring formulations produce gas over time. As a result, a sealed formulation container filled with coloring formulations can be partially filled with unwanted gas when the consumable assembly 300 is initially mounted to the delivery assembly 110. Even embodiments of containers having a two-way breathable membrane, as described above, can accumulate gas within the containers. As will now be described with reference to FIGS. 11-14, embodiments of the disclosed appliance 100 provide degassing of the containers when the consumable assembly 300 is mounted to the delivery assembly 110.

Referring now to FIG. 11, the consumable assembly 300 is shown partially inserted into cavity 118 of the delivery assembly 110. The formulation container 308 of the consumable assembly 300 is in a sealed configuration in which the membrane 332 is intact. The container 308 is filled with a formulation 310 and an amount of gas 312 produced by the formulation due to off-gassing has accumulated within the container. Engagement of the consumable assembly 300 with housing 112 of the delivery assembly aligns each engagement element 144 of the coupler 140 with a corresponding aperture 324 of one of the formulation containers 308. In FIG. 12, the consumable assembly 300 is further inserted into the cavity 118 of the delivery assembly 110 such that tip 146 of the engagement element 144 is in contact with the sealing member 328 and the membrane 332 is still intact. That is, the formulation container 308 is still in a sealed configuration.

Figure 13:
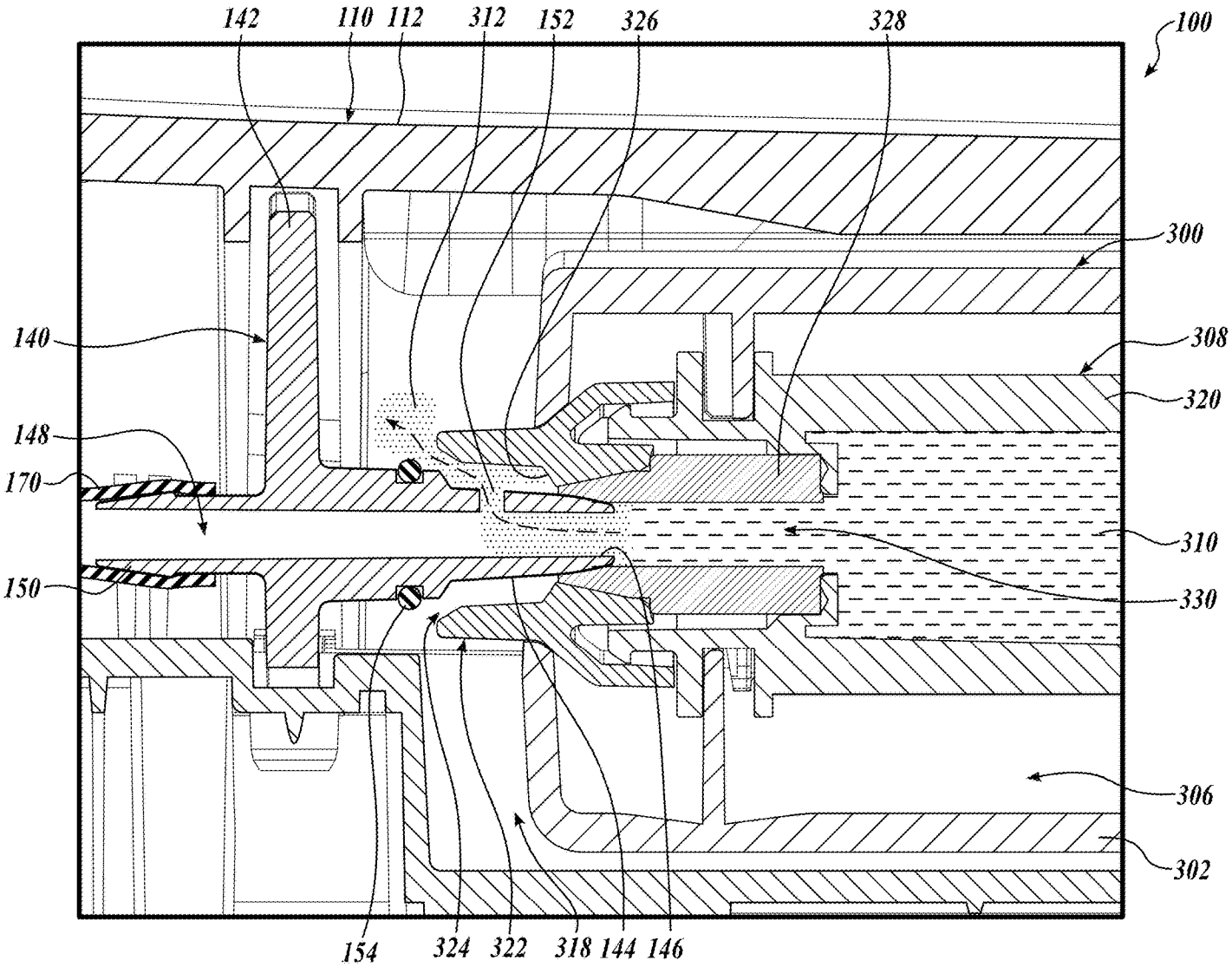
FIG. 13 is a partial side view thereof, wherein the coupler has ruptured a membrane that seals a formulation container of the consumable assembly.

Referring now to FIG. 13, further movement of the consumable assembly 300 into the cavity 118 causes the tip 146 of the engagement element 144 to rupture the membrane 332. With the membrane ruptured, the formulation container is in an unsealed configuration. As the consumable assembly 300 continues to move into the cavity 118, the engagement element 144 is received in sealing engagement by the aperture 330 of the sealing member 328. As a result of this sealing engagement, the channel 148 of the engagement element 144 is in sealed fluid communication with the interior of the formulation container 308. As shown in FIG. 13 a gap exists between the exterior surface of engagement element 144 and the aperture 324 of the end fitting 322. The vent aperture 152 formed in the engagement element 144 opens into this gap. As a result, the gas 312 has a path to vent out of the formulation container 308 so that the container is degassed before initial use.

Figure 14:
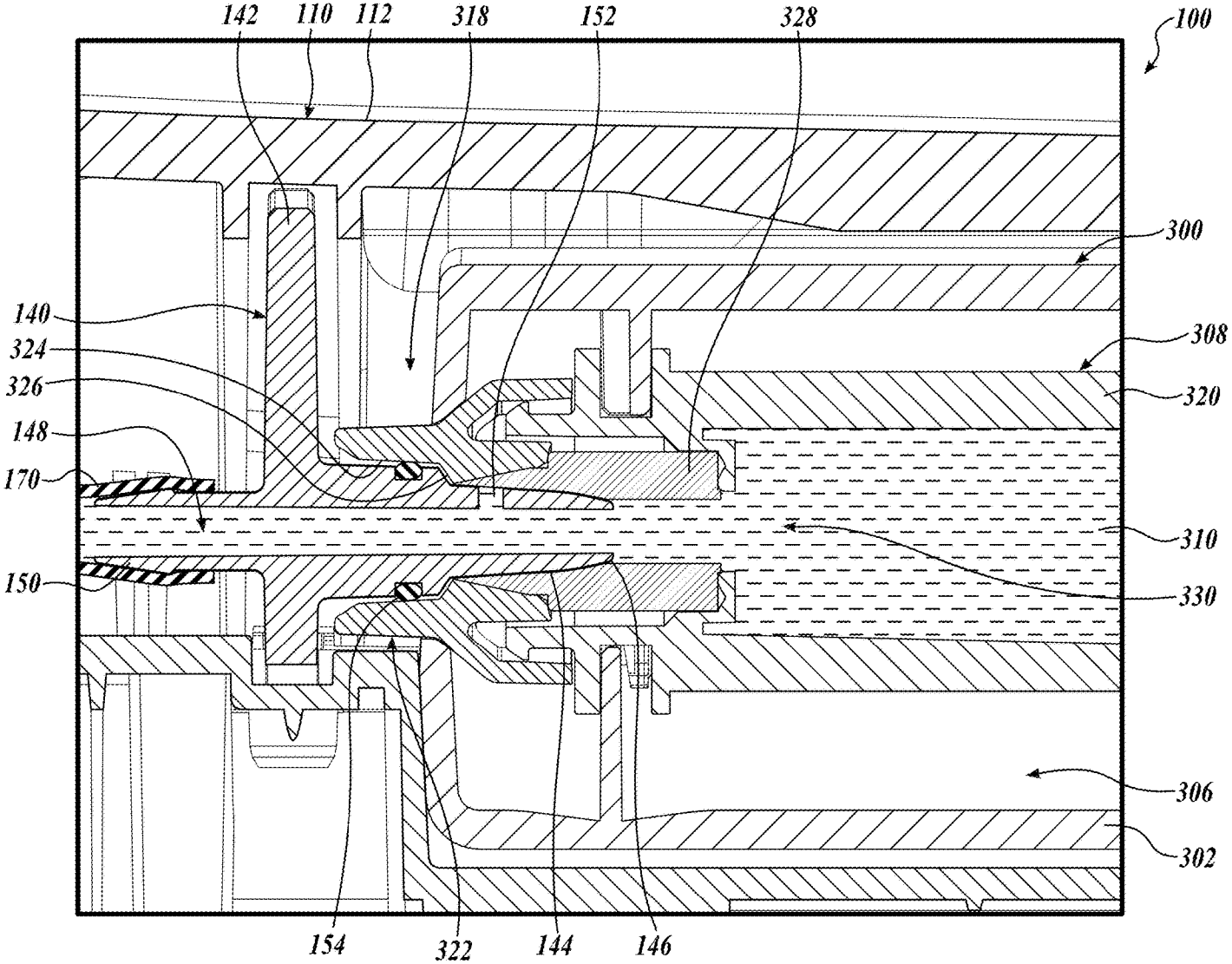
FIG. 14 is a partial side view thereof, wherein the consumable assembly is mounted to the delivery assembly.

FIG. 14 shows the consumable assembly 300 fully mounted to the delivery assembly 110. The engagement element 144 of the coupler 140 is in contact with the stop 326 of the end fitting 322, which prevents further movement of the consumable assembly 300 into the cavity of the delivery assembly 110. As previously described, the release button 304 is engaged with the detent feature 126 of the delivery assembly 110 (see FIG. 3) so that the consumable assembly 300 is releasably coupled to the delivery assembly. The sealing member 154 (O-ring) is in sealing engagement with the end fitting 322 to block the vent path shown in FIG. 13. In some embodiments, engagement of the sealing member 328 of the formulation container 308 with the engagement element 144 covers the vent aperture 152, further blocking the vent path shown in FIG. 14. As a result, the formulation tube 170 is in sealed fluid communication with the interior of the formulation container 308 through the coupler, and the formulation 310 can be drawn from the formulation container by the pump. That is, the appliance 100 is ready for use.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or a substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A formulation delivery appliance, comprising:

a container having an end fitting defining an aperture and a sealing member in sealing engagement with the end fitting, the sealing member having a passageway extending therethrough and being in fluid communication with an interior portion of the container and with the aperture defined by the end fitting, the container being configured to retain a volume of formulation; and an elongate engagement element having a channel extending therethrough and being configured to be at least partially received by the aperture of the container when the container is mounted to the engagement element, a vent aperture being formed in the engagement element and providing fluid communication between the channel and an area outside of the engagement element when the container is disengaged from the engagement element, wherein the vent aperture is sealed and the channel receives a flow of formulation from the container when the container is mounted to the engagement element.

2. The formulation delivery appliance of claim 1, wherein the container further includes a membrane covering the aperture of the container when the container is in a sealed condition.

3. The formulation delivery appliance of claim 2, wherein the engagement element ruptures the membrane as the container is mounted to the engagement element, wherein piercing the membrane changes the container from a sealed condition to an unsealed condition.

4. The formulation delivery appliance of claim 3, wherein the vent aperture is in fluid communication with the formulation when the engagement element is at least partially received within the aperture of the container.

5. The formulation delivery appliance of claim 4, wherein the vent aperture is unsealed as the engagement element ruptures the membrane.

6. The formulation delivery appliance of claim 1, wherein the engagement element sealingly engages the sealing member of the container when the container is mounted to the engagement element.

7. The formulation delivery appliance of claim 6, wherein the sealing member seals the vent aperture when the container is mounted to the engagement element.

8. The formulation delivery appliance of claim 1, wherein an engagement sealing member is mounted to the engagement element, the engagement sealing member providing sealing engagement between the engagement element and the end fitting when the container is mounted to the engagement element.

9. The formulation delivery appliance of claim 1, wherein the engagement sealing member is an O-ring.

10. The formulation delivery appliance of claim 1, wherein the formulation is selected from the group consisting of permanent hair dye, semi-permanent hair dye, developer, conditioner, hair growth treatment, ROGAINE®, hair protein treatment, disulfide bond repairing hair treatment, OLAPLEX®, fluid hair treatment, and fluid scalp treatment.

11. The formulation delivery appliance of claim 1, further comprising:

a second container configured to retain a volume of a second formulation;

a second elongate engagement element configured to be at least partially received by the second container; and a manifold configured to receive the first and second formulations from the first and second containers, respectively.

12. The formulation delivery appliance of claim 11, further comprising a head assembly configured to receive a mixture of the first and second formulations from the manifold and to dispense the mixture to at least one of a user's hair and scalp.

13. A formulation delivery appliance, comprising:

a first container having a first end fitting defining a first aperture and a first sealing member in sealing engagement with the first end fitting, the first sealing member having a passageway extending therethrough and being in fluid communication with an interior portion of the first container and with the aperture, the first container being configured to contain a volume of a first formulation;

a first elongate engagement element having a first channel extending therethrough and being configured to be at least partially received by the first aperture of the first container when the first container is mounted to the first engagement element, a first vent aperture being formed in the first engagement element and providing fluid communication between the first channel and an area outside of the first engagement element when the first container is disengaged from the first engagement element, wherein the first vent aperture is sealed and the first channel receives a flow of the first formulation from the first container when the first container is mounted to the first engagement element;

a pump in fluid communication with the first channel of the first engagement element to withdraw the first formulation from the first fluid container; and a head in fluid communication with the pump, the head being configured to discharge the first formulation.

14. The formulation delivery appliance of claim 13, further comprising:

a second container having a second aperture and being configured to contain a volume of a second formulation;

a second elongate engagement element having a second channel extending therethrough and being configured to be at least partially received by the second aperture of the second container when the second container is mounted to the second engagement element; and a manifold configured to mix first and second formulations received from the pump and to provide a mixture of the first and second formulations to the head.

15. The formulation delivery appliance of claim 14, wherein a second vent aperture is formed in the second engagement element and provides fluid communication between the second channel and an area outside of the second engagement element when the second container is disengaged from the second engagement element, wherein the second vent aperture is sealed and the second channel receives a flow of the second formulation from the second container when the second container is mounted to the first second engagement element.

16. The formulation delivery appliance of claim 15, wherein the first formulation is a hair dye, and the second formulation is a developer.

17. The formulation delivery appliance of claim 14, wherein the first formulation is a hair dye, and the second formulation is a developer.

* * * * *